United States Patent [19]

Wick

[11] 4,221,202

[45] Sep. 9, 1980

[54] AIR VANE CARBURETOR WITH ADJUSTABLE SPEED

[75] Inventor: Gerald H. Wick, Galesburg, Ill.

[73] Assignee: Outboard Marine Corporation, Waukegan, Ill.

[21] Appl. No.: 915,662

[22] Filed: Jun. 15, 1978

[51] Int. Cl.[2] ..... F02D 11/02

[52] U.S. Cl. ..... 123/378; 56/10.2; 123/198 D; 123/403

[58] Field of Search ..... 123/103 R, 103 B, 103 E, 123/179 SE, 108, 198 D, 198 DB; 56/10.2

[56] References Cited

U.S. PATENT DOCUMENTS

| | | | |
|---|---|---|---|
| 3,199,530 | 8/1965 | Svendsen | 123/103 D |
| 3,640,253 | 2/1972 | Glover et al. | 123/103 B |
| 3,650,252 | 3/1972 | Glover et al. | 123/103 B |
| 3,905,348 | 9/1975 | Williams | 123/198 D |
| 4,108,120 | 8/1978 | Woelffer | 123/103 B |

*Primary Examiner*—Charles J. Myhre
*Assistant Examiner*—Craig R. Feinberg
*Attorney, Agent, or Firm*—Michael, Best & Friedrich

[57] ABSTRACT

Disclosed herein is a lawn mower including a blade housing, wheels for supporting the blade housing for movement along the ground, a rotary blade supported in the blade housing, and an internal combustion engine supported by the blade housing and rotatably driving the blade. The internal combustion engine includes a carburetor, a movable throttle control for controlling fluid flow through the carburetor, the throttle control being movable from an open position to a flow restricting position, a movable air vane connected to the throttle control for moving the throttle control, and a fan for forcing air against the air vane and for urging the throttle control to the flow restricting position. The engine further includes a spring connected to the throttle control for urging the throttle control to the open position, and a control member connected to the spring, the control member being movable between a first spring force level position and a second spring force level position for varying the force of the spring on the throttle control.

7 Claims, 6 Drawing Figures

AIR VANE CARBURETOR WITH ADJUSTABLE SPEED

BACKGROUND OF THE INVENTION

The present invention relates to power driven lawn mowers and more particularly to lawn mowers including internal combustion engines having governors for controlling the speed of operation of the lawn mower. It is commonly desirable that the engine speed of the lawn mower be adjustable by the mower operator between at least two speeds. However, engine efficiency and durability are improved if the engine operates at a generally constant speed for each of the preselected operating speeds. Accordingly, it is beneficial if the engine is provided with a speed control mechanism which permits the operator to select one of a plurality of operating speeds and which maintains the engine operating speed at the selected value. It is further desirable that the speed control mechanism be adjustable during assembly of the lawn mower to permit preadjustment of the preselected engine speeds.

Attention is directed to U.S. Patent Application Ser. No. 915,764, filed June 15, 1978, and assigned to the assignee of the present invention.

SUMMARY OF THE INVENTION

The present invention provides an internal combustion engine comprising a carburetor, a movable throttle for controlling fluid flow through the carburetor, which throttle is movable from an open position to a flow restricting position, a movable air vane connected to the throttle for moving the throttle, means responsive to engine rotation for forcing air against the air vane so as to urge the throttle to the flow restricting position, a spring for urging the throttle to the open position, which spring includes opposite ends, one of the opposite ends being connected to the throttle, and means for varying the force of the spring on the throttle and including a control member movably between a first spring force level position and a second spring force level position, which control member includes a cylindrical portion and a second portion extending from the cylindrical portion. The force varying means further includes an annular collar which surrounds the cylindrical portion, which is connected to the other of the opposite ends of the spring, and which is movable in the direction of the axis of the cylindrical portion between a first position wherein the collar is disengaged from the control member and is thereby rotatable relative to the cylindrical portion for adjusting the tension of the spring and a second position, means for effecting common rotation of the collar and the control member when the collar is in the second position, and means independent of the spring for releasably precluding axial movement of the collar from the second position to the first position.

One of the principal features of the invention is the provisions of means for preadjusting the tension of the spring, the preadjusting means including a preadjusting member connected to one end of the spring and selectively securing the preadjusting member to the control member for movement with the control member.

Another of the principal features of the invention is the connection of one of the opposite ends of the spring means to the throttle control, the use of a control member having a cylindrical portion and a lever arm extending from the cylindrical portion, and the use of a collar which is connected to the other of the opposite ends of the spring and which is movable between a first position wherein the collar is rotatable relative to the cylindrical portion of the control member for adjusting the tension of the spring means and a second position wherein the collar is engaged with the cylindrical portion for common rotation.

Another of the principal features of the invention is the provision in the cylindrical portion of the control member of a central bore housing a rotatable shaft connecting the air vane and the throttle control.

Another of the principal features of the invention is the inclusion in the securing means of splines which are located on the collar and on the cylindrical portion of the control member and which are in mating engagement when the collar is in the second position.

Other features and advantages of the embodiment of the invention will become apparent to those skilled in the art upon reviewing the following detailed description, the drawings and the appended claims.

Figure 1:
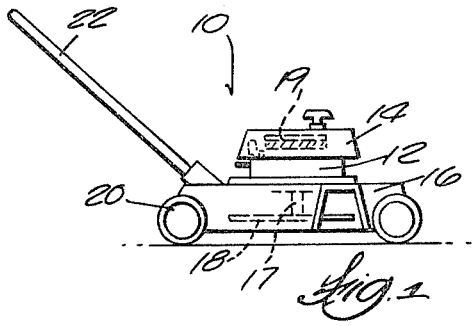
FIG. 1 is a side elevation view of a lawn mower embodying the present invention.

Before explaining one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Illustrated in FIG. 1 is a lawn mower 10 including an internal combustion engine 12 partially covered by a shroud 14 and supported on a frame including a blade housing 16. The engine 12 rotatably drives an engine drive shaft 17 having a rotary cutting blade 18 attached to its lower end. The upper end of the drive shaft 17 drives a rotary cooling fan 19. The mower 10 is supported for movement along the ground by wheels 20 and is guided by a guiding handle 22.

Figure 3:
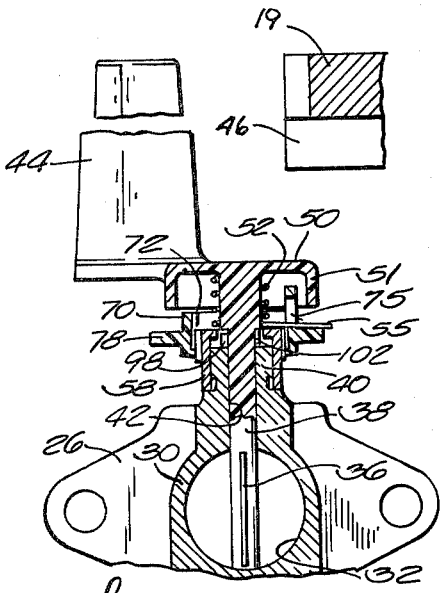
FIG. 3 is a cross-section view of the air vane governor assembly shown in FIG. 2 and showing an adjustment collar in an adjustable position.

Referring to FIG. 3, the internal combustion engine 12 is provided with a carburetor 26 having a throat 30. The speed of the engine 12 is governed by the flow of the fuel mixture through a cylindrical bore 32 of the throat 30. An air vane operated throttle control assembly is provided to regulate the flow of the fuel mixture through the throat 30. The throttle assembly includes a thin generally circular throttle disc 36 pivotably supported in the throat 30 for pivotal movement between a flow restricting position wherein the throttle disc 36 is transverse to the longitudinal axis of the throat 30, and an open position, as shown in FIGS. 3 and 4, wherein the throttle disc 36 is parallel to the longitudinal axis of the throat 30 and the flow through the throat is substantially unrestricted by the throttle disc 36.

The throttle disc 36 is joined to the lower end of a throttle control shaft 38 extending into the cylindrical bore 32 of the throat 30 and is supported for rotation about a vertical axis generally perpendicular to the longitudinal axis of the cylindrical bore 32. The throttle control shaft 38 is rotatably supported within a central bore 42 of a cylindrical stem 40 extending vertically upwardly from the throat 30 and integrally joined thereto.

Figure 2:
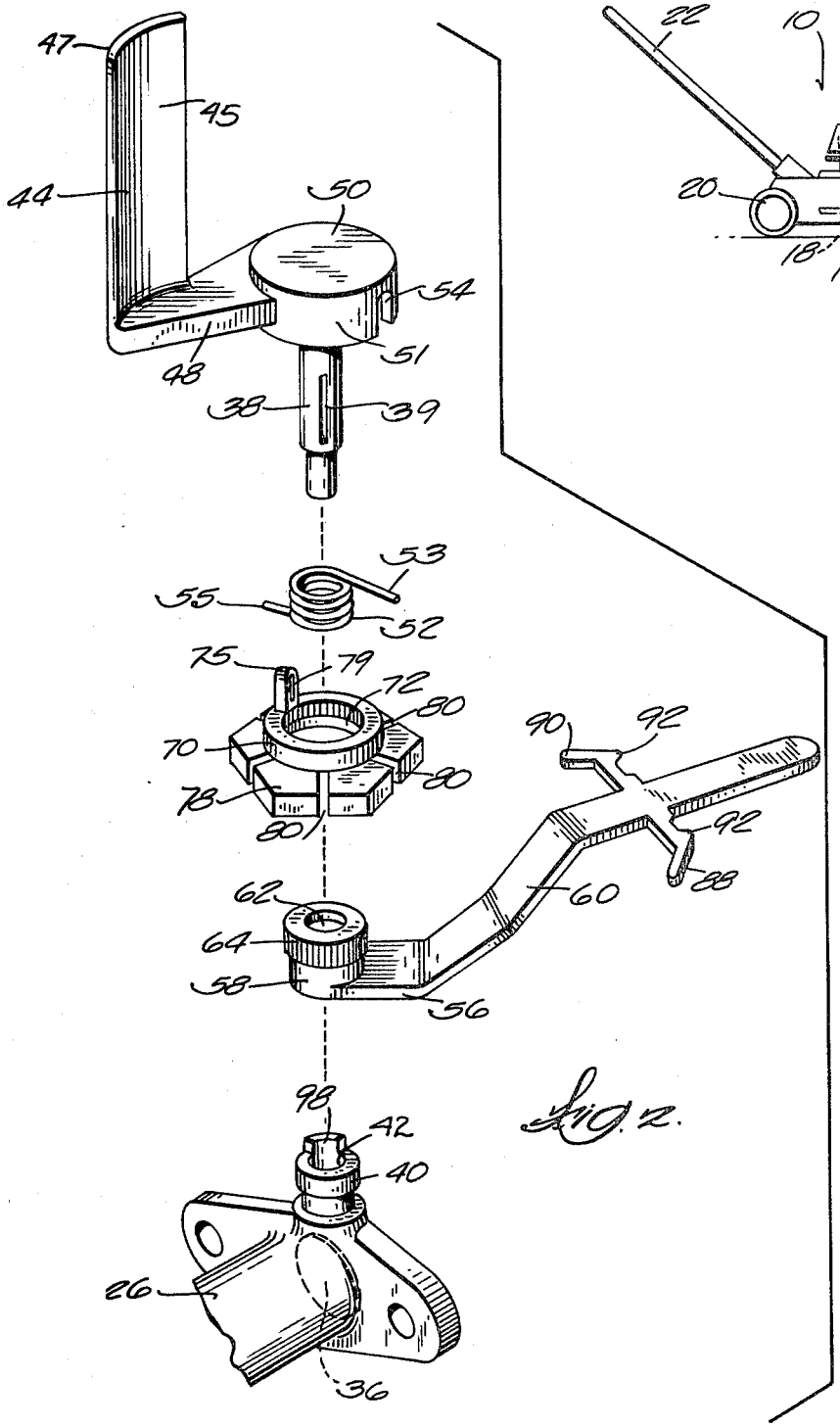
FIG. 2 is an enlarged exploded perspective view of an air vane governor assembly of the engine of the lawn mower shown in FIG. 1.

An air vane 44 is attached to the upper end of the throttle shaft 38 and is functional to control pivotal movement of the throttle disc 36 between its open position and its flow restricting position. The rotary cooling fan 19, attached to the engine drive shaft 17, includes a plurality of radially extending impeller blades 46, shown in FIGS. 3 and 4. The air vane 44 is positioned adjacent to the periphery of the fan 19 such that rotation of the fan 19 causes the impeller blades 46 to impel air against the surface of the air vane to apply a force on the air vane 44 proportional to the speed of rotation of the fan, i.e., proportional to the speed of the engine 12. As shown in FIG. 2, in one preferred embodiment of the invention, the air vane 44 can be comprised of a vertically extending generally rectangular blade curved about a vertical axis and having concave and convex vertical surfaces 45 and 47, respectively, and the air vane 44 is positioned such that the concave surface 45 is in opposed relation to the periphery of the fan 19. The air vane 44 is spaced from the longitudinal axis of the throttle shaft 38 and is connected to the throttle shaft 38 by an air vane supporting lever 48 having one end connected to the air vanes 44 and an opposite end connected to a circular vane supporting body 50. The vane supporting body 50 is in turn integrally connected to the upper end of the throttle shaft 38. The air vane 44 is positioned such that when the fan 19 forces air against the air vane 44, the air vane 44 and the air vane supporting lever 48 apply a torque on the throttle shaft 38 to bias the throttle disc 36 toward a flow restricting position.

Figure 4:
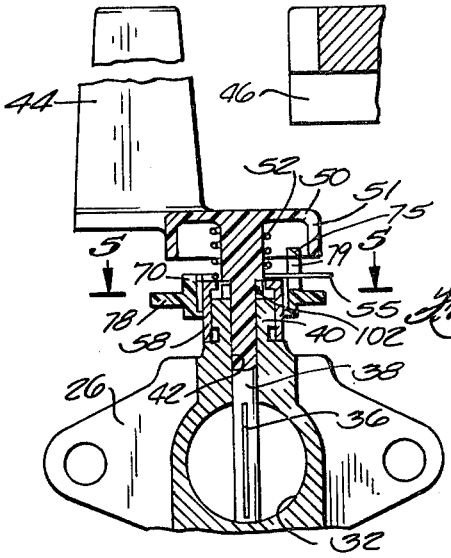
FIG. 4 is a view similar to FIG. 3 but showing the air vane governor assembly with the adjustment collar in a position wherein adjustment of the engine speed regulating means is precluded.

In the preferred embodiment of the invention shown in FIGS. 2, 3 and 4, the air vane 44, the vane supporting lever 48, the vane supporting body 50, and the throttle shaft 38 can be integrally formed from molded plastic, and the throttle shaft 38 includes a longitudinal slot 39 in its lower end for supporting the throttle disc 36. In an alternative embodiment of the invention, the throttle control assembly could also be comprised of discrete components mechanically joined together.

The torque of the air vane 44 on the throttle shaft 38 is balanced by a force from a torsional governor spring 52 acting on the throttle shaft 38 and urging the throttle disc 36 toward its open position. The air vane 44 and the torsional governor spring 52 thus function in combination to control the engine speed. The spring 52 biases the throttle disc 36 to an open position to permit increased fuel mixture flow through the carburetor 26. Such increased flow of the fuel mixture causes the speed of the engine 12 to increase, and the speed of rotation of the rotary fan 19 increases. Accordingly, as airflow from the fan 19 onto the air vane 44 exerts an increased torque on the throttle shaft 38, the throttle disc 36 pivots toward a flow restricting position thereby reducing the engine speed. In the event that the speed of the engine 12 is caused to be reduced by the blade 18 encountering a resistance, such as heavy grass, the fan 19 will have a reduced rotational speed. The force on the air vane 44 will be reduced and the torsional governor spring 52 will bias the throttle disc 36 toward an open position, whereby increased fluid flow through the carburetor 26 is permitted and the engine speed will be increased. In this manner, torsional governor spring 52 and the air vane 44, in combination with the cooling fan 19, tend to cause the engine 12 to operate at a selected speed and to compensate for loads placed on the engine.

The torsional governor spring 52 is shown in FIGS. 2, 3 and 4 as being a helically wound spring having opposite ends, one of the ends 53 being held in a slot 54 in a downwardly extending peripheral wall 51 of the vane supporting body 50. The other end 55 of the spring 52 is operably connected to a speed control member or lever 56. As described above, the speed of the engine 12 in operation is governed by the tension in the torsional governor spring 52. The speed control lever 56 is movable between a low speed position and a high speed position, such movement of the speed control lever functioning to increase or decrease the tension in the spring 52 to thereby affect pivotal movement of the throttle disc 36. If the lever 56 is pivoted to a low speed position, the tension in the torsional governor spring is decreased. The torque applied by the air vane 44 on the throttle shaft 38 will accordingly cause the throttle disc 36 to be urged toward a flow restricting position. If, on the other hand, the lever 56 is moved to a high speed position, the tension in the torsional governor spring will be increased such that a greater force on the air vane 44 will be required to cause movement of the throttle disc 36 toward a flow restricting position.

The speed control lever 56 includes a cylindrical portion 58 and a lever arm portion 60. The cylindrical portion 58 of the speed control lever 56 includes therein a central bore 62 and is pivotably supported on the stem 40 of the carburetor for pivotal movement about the axis of the stem 40 and the throttle shaft 38. To prevent removal of the speed control lever 56 from the stem 40, the cylindrical portion 58 includes an inwardly extending annular lip 59 at its lower end, the annular lip 59 being intended to snap into an annular groove 61 surrounding the stem 40 (FIG. 6).

The torsional governor spring 52 is connected to the speed control lever 56 by an adjustment collar 70 surrounding the cylindrical portion 58 of the lever 56. An end 55 of the torsional governor spring 52 is held in an aperture 79 in a flange 75 extending upwardly from the collar 70 and integrally joined thereto. The collar 70 includes a central bore 72 surrounding the upper end of the cylindrical portion 58 of the speed control lever 56. The collar 70 includes a plurality of splines 74 extending inwardly from the upper portion of the bore 72, the splines 74 being intended to matingly engage with splines 64 surrounding the upper portion of the cylindrical portion 58. The opposite or lower end of the bore 72 supports an inwardly extending annular lip 76 (FIG. 6) surrounding the bore 72. The collar 70 further includes an annular flange 78 extending outwardly from the lower peripheral portion of the collar 70. The periphery of the annular flange 78 has a hexagonal configuration and the annular flange 78 includes a plurality of radial slots 80 cut therein and extending inwardly from the periphery to the central bore 72. The radial slots 80 are intended to permit radial outward expansion of the annular lip 76 so that the collar 70 can be forced over the splines 64 as shown in FIG. 3.

The speed of the engine 12 is governed by the load and the rate of the torsional governor spring 52. Preadjustment of the tension in the torsional governor spring 52, to thereby permit adjustment of the engine speed, can be accomplished by rotating the collar 70 relative to the cylindrical lever portion 58. To facilitate such preadjustment of the tension in the torsional governor spring 52 during assembly of the lawn mower 10, the collar 70 is positioned by the cylindrical lever portion 58 in the manner shown in FIG. 3 such that the inwardly extending lip 76 surrounding the bore 72 of the collar 70 surrounds the splines 64. In this position, the collar 70 is rotatable relative to the cylindrical lever portion 58 to permit adjustment of the tension in the torsional governor spring 52 and consequent preadjustment of the speed of the engine 12. When the desired tension in the torsional governor spring 52 has been achieved, the collar 70 can then be forced downwardly in the direction of the longitudinal axis of the cylindrical lever portion 58 to the position shown in FIGS. 4 and 6, wherein the inwardly extending splines 74 of the collar 70 engage the splines 64 surrounding the cylindrical lever portion 58 to thereby prevent relative rotation between the collar 70 and the cylindrical lever portion 58. By providing fine splines 64 and 74, accurate preadjustment of the engine speed can be achieved.

Figure 6:
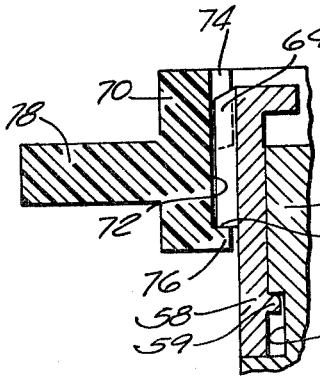
FIG. 6 is an enlarged partial view of the splined engagement of the adjustment collar and the speed control lever shown in FIG. 4.

When the collar 70 is in the position shown in FIGS. 4 and 6, the inwardly extending annular lip 76 surrounding the lower end of the central bore 72 of the collar 70 will snap into engagement with the shoulder 65 formed by the lower ends of the splines 64 surrounding the cylindrical lever portion 58. The collar 70 is thus locked onto the cylindrical lever portion 58 in a snap fit relationship and is precluded from subsequent rotational adjustment with respect to the cylindrical lever portion 58.

Means are further provided for releasably and selectively holding the lever 56 in the high and low speed positions. While various arrangements can be employed, in the illustrated construction the lever arm portion 60 includes a pair of laterally extending detent flanges 88 and 90 projecting from the opposite edges of the lever arm portion 60 and intermediate its ends, and the lever arm portion 60 of the lever 56 is restrained for movement between the carburetor body and a lever restraining bar 82, the lever restraining bar 82 being secured to the carburetor 26 by a pair of bolts 84 and 86. The detent flanges 88 and 90 are each resilient and include a lobe 92 intended to engage detent projections 94 extending radially outwardly from spacer sleeves 96 surrounding the respective bolts 84 and 86. When the speed selector lever 56 is in the high speed position shown in FIG. 5, the detent flange 90 engages the detent projection 94 extending from the sleeve 96 surrounding the bolt 86 to thereby releasably prevent the lever arm 60 of lever 56 from moving away from that position. When the speed selector lever 56 is in the low speed position shown in phantom in FIG. 5, the detent flange 88 engages the detent projection 94 extending from the sleeve 96 surrounding bolt 84. The lever arm 60 is accordingly releasably restrained in the low speed position.

Figure 5:
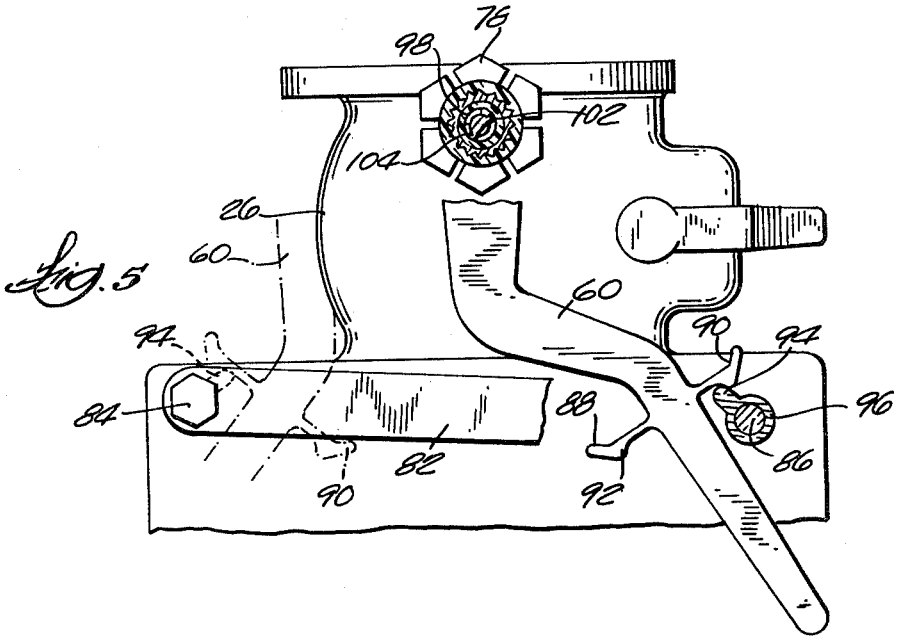
FIG. 5 is a cross-section view taken along line 5—5 in FIG. 4 and with portions broken away in the interest of clarity.

Referring to FIGS. 2 and 5, the extent of pivotal movement of the throttle disc 36 is also restricted by a pair of projections 102 and 104 extending outwardly from the stem 38 and selectively engageable with an arcuate stop number 98 projecting upwardly from the stem 40.

Though the detent mechanism described above provides means for causing operation of the engine at two selected speeds, alternative detent means could also be provided for permitting operation of the engine at a plurality of operating speeds.

Various of the features of the invention are set forth in the following claims.

What is claimed is:

1. An internal combustion engine comprising a carburetor, a movable throttle for controlling fluid flow through said carburetor, said throttle being movable from an open position to a flow restricting position, a movable air vane connected to said throttle for moving said throttle, means responsive to engine rotation for forcing air against said air vane so as to urge said throttle to said flow restricting position, a spring for urging said throttle to said open position, said spring including opposite ends, one of said opposite ends being connected to said throttle, and means for varying the force of said spring on said throttle and including a control member movable between a first spring force level position and a second spring force level position, said control member including a cylindrical portion and a second portion extending from said cylindrical portion, said force varying means further including an annular collar which surrounds said cylindrical portion, which is connected to the other of said opposite ends of said spring, and which is movable in the direction of the axis of said cylindrical portion between a first position wherein said collar is disengaged from said control member and is thereby rotatable relative to said cylindrical portion for adjusting the tension of said spring and a second position, means for effecting common rotation of said collar and said control member when said collar is in said second position, and means independent of said spring for releasably precluding axial movement of said collar from said second position to said first position.

2. An internal combustion engine comprising a carburetor, a movable throttle for controlling fluid flow through said carburetor, said throttle being movable from an open position to a flow restricting position, a movable air vane connected to said throttle for moving said throttle, means responsive to engine rotation for forcing air against said air vane so as to urge said throttle to said flow restricting position, a spring for urging said throttle to said open position, said spring including opposite ends, one of said opposite ends being connected to said throttle, and means for varying the force of said spring on said throttle and including a control member movable between a first spring force level position and a second spring force level position, said control member including a cylindrical portion and a second portion extending from said cylindrical portion, said force varying means further including an annular collar which surrounds said cylindrical portion, which is connected to the other of said opposite ends of said spring, and which is movable in the direction of the axis of said cylindrical portion between a first position wherein said collar is disengaged from said control member and is thereby rotatable relative to said cylindrical portion for preadjusting the tension of said spring and a second position, means for effecting common rotation of said collar and said cylindrical portion when said collar is in said second position, said means for effecting common rotation extending between said collar and said cylindrical portion in mating engagement when said collar is in said second position, and means for releasably precluding axial movement of said collar from said second position to said first position, said means for precluding axial movement including an inwardly extending lip projecting from said collar, and a shoulder extending from said cylindrical portion for releasable engagement by said inwardly extending lip when said collar is in said second position.

3. An internal combustion engine as set forth in claim 2 wherein said carburetor includes a throat and wherein said throttle control includes a throttle disc positioned in said throat and pivotable from an open position to a fluid flow restricting position, and a rotatable shaft connected to said air vane and to said throttle disc so as to move said throttle disc in response to movement of said air vane.

4. An internal combustion engine as set forth in claim 2 and further including detent means for releasably restraining said control member when said control member is in said first spring force level position and for releasably restraining said control member when said control member is in said second spring force level position.

5. An internal combustion engine as set forth in claim 2 and further including means for limiting pivotal movement of said control member to movement between said first spring force level position and said second spring force level position.

6. An internal combustion engine in accordance with claim 2 wherein said control lever is movable to a range of positions between said first and second spring force level positions.

7. An internal combustion engine in accordance with claim 2 wherein said carburetor includes a throat and a cylindrical stem projecting transversely from said throat and having a central bore and wherein said control member is rotatably mounted on said stem, and further including a shaft which extends through said central bore and which directly connects said air vane and said throttle.

* * * * *